US009576472B2

(12) United States Patent
Koch

(10) Patent No.: US 9,576,472 B2
(45) Date of Patent: Feb. 21, 2017

(54) REAL-TIME MONITORING AND DISSEMINATION OF ENERGY CONSUMPTION AND PRODUCTION DATA

(71) Applicant: Tendril Networks, Inc., Boulder, CO (US)

(72) Inventor: Mark Koch, Broomfield, CO (US)

(73) Assignee: Tendril Networks, Inc., Boulder, CO (US)

( * ) Notice: Subject to any disclaimer, the term of this patent is extended or adjusted under 35 U.S.C. 154(b) by 702 days.

(21) Appl. No.: 13/761,124

(22) Filed: Feb. 6, 2013

(65) Prior Publication Data

US 2014/0218209 A1 Aug. 7, 2014

(51) Int. Cl.
*G08B 23/00* (2006.01)
*G08C 17/02* (2006.01)

(52) U.S. Cl.
CPC ..... *G08C 17/02* (2013.01); *G08C 2201/112* (2013.01); *G08C 2201/114* (2013.01)

(58) Field of Classification Search
None
See application file for complete search history.

(56) References Cited

U.S. PATENT DOCUMENTS

| | | | |
|---|---|---|---|
| 5,179,556 | A | 1/1993 | Turner |
| 5,572,438 | A | 11/1996 | Ehlers et al. |
| 5,684,710 | A | 11/1997 | Ehlers et al. |
| 5,696,695 | A | 12/1997 | Ehlers et al. |
| 5,719,861 | A | 2/1998 | Okanoue |
| 5,865,991 | A | 2/1999 | Hsu |
| 5,924,486 | A | 7/1999 | Ehlers et al. |
| 5,949,976 | A | 9/1999 | Chappelle |
| 5,959,529 | A | 9/1999 | Kail, IV |
| 6,028,857 | A | 2/2000 | Poor |
| 6,092,207 | A | 7/2000 | Kolinski et al. |

(Continued)

FOREIGN PATENT DOCUMENTS

| | | |
|---|---|---|
| WO | WO-0074306 | 12/2000 |
| WO | WO-2012068503 | 5/2012 |

OTHER PUBLICATIONS http://www.diykyoto.com/, accessed on Aug. 9, 2010.

(Continued)

*Primary Examiner* — Curtis King
(74) *Attorney, Agent, or Firm* — Perkins Coie LLP

(57) ABSTRACT

A facility comprising systems, methods, and techniques for collecting data indicative of energy consumption and/or energy production by energy systems and devices and providing the data to interested users and devices in real-time is described. The facility may comprise an energy gateway device coupled to one or more monitored devices, one or more energy data extraction servers, and one or more client computers. The energy gateway devices and energy data extraction servers are coupled to a network and are configured to collect energy consumption and/or energy production data from one or more devices and provide an indication of the collected data in real-time or near real-time. The facility may collect current energy consumption or production rates, predicted energy consumption or production levels over a future period of time, and/or amounts of energy that has been consumed or produced by the device over a previous period of time.

20 Claims, 6 Drawing Sheets

(56) References Cited

U.S. PATENT DOCUMENTS

| | | | | |
|---|---|---|---|---|
| 6,178,362 | B1 | 1/2001 | Woolard et al. | |
| 6,208,247 | B1 | 3/2001 | Agre et al. | |
| 6,216,956 | B1 | 4/2001 | Ehlers et al. | |
| 6,631,309 | B2 | 10/2003 | Boies et al. | |
| 6,640,248 | B1 | 10/2003 | Jorgensen | |
| 6,680,922 | B1 | 1/2004 | Jorgensen | |
| 6,684,339 | B1 | 1/2004 | Willig | |
| 6,785,592 | B1 | 8/2004 | Smith et al. | |
| 6,859,831 | B1 | 2/2005 | Gelvin et al. | |
| 6,947,483 | B2 | 9/2005 | Engwer | |
| 7,058,657 | B1 | 6/2006 | Berno | |
| 7,062,389 | B2 | 6/2006 | Johnson et al. | |
| 7,130,719 | B2 | 10/2006 | Ehlers et al. | |
| 7,171,287 | B2 | 1/2007 | Weiss | |
| 7,245,947 | B2 | 7/2007 | Salokannel et al. | |
| 7,263,450 | B2 | 8/2007 | Hunter | |
| 7,266,428 | B2 | 9/2007 | Alexanian | |
| 7,302,634 | B2 | 11/2007 | Lucovsky | |
| 7,333,821 | B2 | 2/2008 | Willey | |
| 7,356,548 | B1 | 4/2008 | Culp et al. | |
| 7,505,852 | B2 | 3/2009 | Board | |
| 7,552,033 | B1 | 6/2009 | Culp et al. | |
| 8,176,095 | B2 | 5/2012 | Murray et al. | |
| 8,239,046 | B2 | 8/2012 | Koehler et al. | |
| 8,265,776 | B2 * | 9/2012 | Osann, Jr. | 700/22 |
| 2002/0002636 | A1 | 1/2002 | Vange et al. | |
| 2002/0071398 | A1 | 6/2002 | Moran et al. | |
| 2002/0154161 | A1 * | 10/2002 | Friedman | G08C 17/00 715/740 |
| 2002/0158763 | A1 * | 10/2002 | Takarada et al. | 340/573.1 |
| 2003/0069970 | A1 | 4/2003 | Kim et al. | |
| 2003/0190912 | A1 | 10/2003 | Jampolsky et al. | |
| 2004/0117330 | A1 | 6/2004 | Ehlers et al. | |
| 2004/0133314 | A1 | 7/2004 | Ehlers et al. | |
| 2004/0138981 | A1 | 7/2004 | Ehlers et al. | |
| 2004/0139038 | A1 | 7/2004 | Ehlers et al. | |
| 2004/0249515 | A1 | 12/2004 | Johnson et al. | |
| 2004/0260411 | A1 | 12/2004 | Cannon | |
| 2004/0262410 | A1 | 12/2004 | Hull | |
| 2005/0038571 | A1 | 2/2005 | Brickfield et al. | |
| 2005/0043829 | A1 | 2/2005 | Rossides | |
| 2005/0096060 | A1 | 5/2005 | Rajkotia et al. | |
| 2005/0096857 | A1 | 5/2005 | Hunter | |
| 2005/0124358 | A1 | 6/2005 | Willey | |
| 2005/0157723 | A1 | 7/2005 | Kim et al. | |
| 2006/0200542 | A1 | 9/2006 | Willig | |
| 2006/0209789 | A1 | 9/2006 | Gupta et al. | |
| 2007/0043477 | A1 | 2/2007 | Ehlers et al. | |
| 2007/0043478 | A1 | 2/2007 | Ehlers et al. | |
| 2007/0097993 | A1 | 5/2007 | Bojahra et al. | |
| 2007/0174644 | A1 | 7/2007 | Willig | |
| 2007/0251461 | A1 | 11/2007 | Reichard et al. | |
| 2008/0021749 | A1 * | 1/2008 | Hope | 705/7 |
| 2008/0129495 | A1 | 6/2008 | Hitt | |
| 2008/0263196 | A1 | 10/2008 | Kansal et al. | |
| 2008/0306985 | A1 | 12/2008 | Murray et al. | |
| 2009/0007706 | A1 | 1/2009 | Hitt et al. | |
| 2009/0045256 | A1 | 2/2009 | McInerney et al. | |
| 2009/0059842 | A1 | 3/2009 | Maltseff et al. | |
| 2010/0010678 | A1 | 1/2010 | Dawson et al. | |
| 2010/0031324 | A1 | 2/2010 | Strich et al. | |
| 2010/0042453 | A1 | 2/2010 | Scaramellino et al. | |
| 2010/0070101 | A1 | 3/2010 | Benes et al. | |
| 2010/0070102 | A1 | 3/2010 | Benes et al. | |
| 2010/0156665 | A1 * | 6/2010 | Krzyzanowski et al. | 340/870.02 |
| 2011/0032070 | A1 * | 2/2011 | Bleile | 340/3.51 |
| 2011/0166710 | A1 | 7/2011 | Kordik et al. | |
| 2011/0178651 | A1 * | 7/2011 | Choi | G01D 4/002 700/295 |
| 2011/0251807 | A1 * | 10/2011 | Rada et al. | 702/61 |
| 2012/0323637 | A1 | 12/2012 | Cushing et al. | |
| 2013/0013121 | A1 | 1/2013 | Henze et al. | |
| 2013/0170481 | A1 * | 7/2013 | Crawford et al. | 370/338 |
| 2013/0178986 | A1 * | 7/2013 | Lombard et al. | 700/276 |

OTHER PUBLICATIONS http://www.theenergydetective.com/home, accessed on Aug. 9, 2010.
http://www.bluelineinnovations.com, accessed on Aug. 9, 2010.
http://www.theowl.com/, accessed on Aug. 9, 2010.
http://www.ambientdevices.com/products/energyjoule.html, accessed on Aug. 9, 2010.
http://hes.lbl.gov/consumer, accessed on Aug. 9, 2010.
http://www.greenenergyoptions.co.uk/, accessed on Aug. 9, 2010.
http://onzo.com/solutions/, accessed on Aug. 9, 2010.
http://www.opower.com/Products/Overview.aspx, accessed on Aug. 9, 2010.
http://www.alertme.com/, accessed on Aug. 9, 2010.
http://silverspringnetworks.com/products/index.html, accessed on Aug. 9, 2010.
http://www.agilewaves.com/, accessed on Aug. 9, 2010.
http://www.energyhub.net, accessed on Aug. 9, 2010.
http://www.tendrilinc.com/products/vision/,accessed on Aug. 9, 2010.
http://www.powermand.com/dreamwatts-product, accessed on Aug. 9, 2010.
http://www.energy-aware.com/, accessed on Aug. 9, 2010.
http://www.consert.com/, accessed on Aug. 9, 2010.
http://www.lem.com/hq/en/content/view/276/215/, accessed on Aug. 9, 2010.
http://www.google.com/powermeter/about/, accessed on Aug. 9, 2010.
http://blog.microsoft-hohm.com/Hohm-energy-report-sample.aspx, accessed on Aug. 9, 2010.
http://efficiency20.com/, accessed on Aug. 9, 2010.
Retzlaff et al. Conservation & Energy Potential Study for Smith River Rancheria:, Smith River Rancheria, Evergreen NRG/Strategic Energy Solutions, Aug. 2005, 417 pages.
U.S. Appl. No. 61/446,233; Inventor: Henze; Date of Filing: Feb. 24, 2011, 17 pages.
Kennedy, James and Russell Eberhart. "Particle Swarm Optimization," Proceedings of the IEEE International Conference on Neural Networks (Perth, Australia), 1995, pp. 1942-1948.
Doebber, I."Investigation of Concrete Wall Systems for Reducing Heating nad Cooling Requirements in Single Family Residences" [online], Sep. 2004 [retrieved on Mar. 9, 2014]. Retrieved from the Internet:<URL: http://scholar.lib.vt.edu/theses/available/etd-10262004-21448/unrestricted/FinalThesis.pdf>.
International Search Report and Written Opinion; International Application No. PCT/US2011/061470; mailed Apr. 9, 2014; 9 pages.

* cited by examiner

REAL-TIME MONITORING AND DISSEMINATION OF ENERGY CONSUMPTION AND PRODUCTION DATA

BACKGROUND

As non-renewable energy resources are being depleted and energy costs become increasingly more expensive and volatile, consumers continue to seek out ways to monitor and reduce their energy consumption and energy costs. Energy systems often include energy-consuming devices (i.e., devices configured to consume more energy than they produce) and energy-producing devices (i.e., devices configured to produce more energy than they consume). An intelligent system for monitoring the consumption and/or production of energy by energy systems and devices and providing data indicative of the monitored consumption and/or production to local and remote devices is desired.

DETAILED DESCRIPTION

Figure 1:
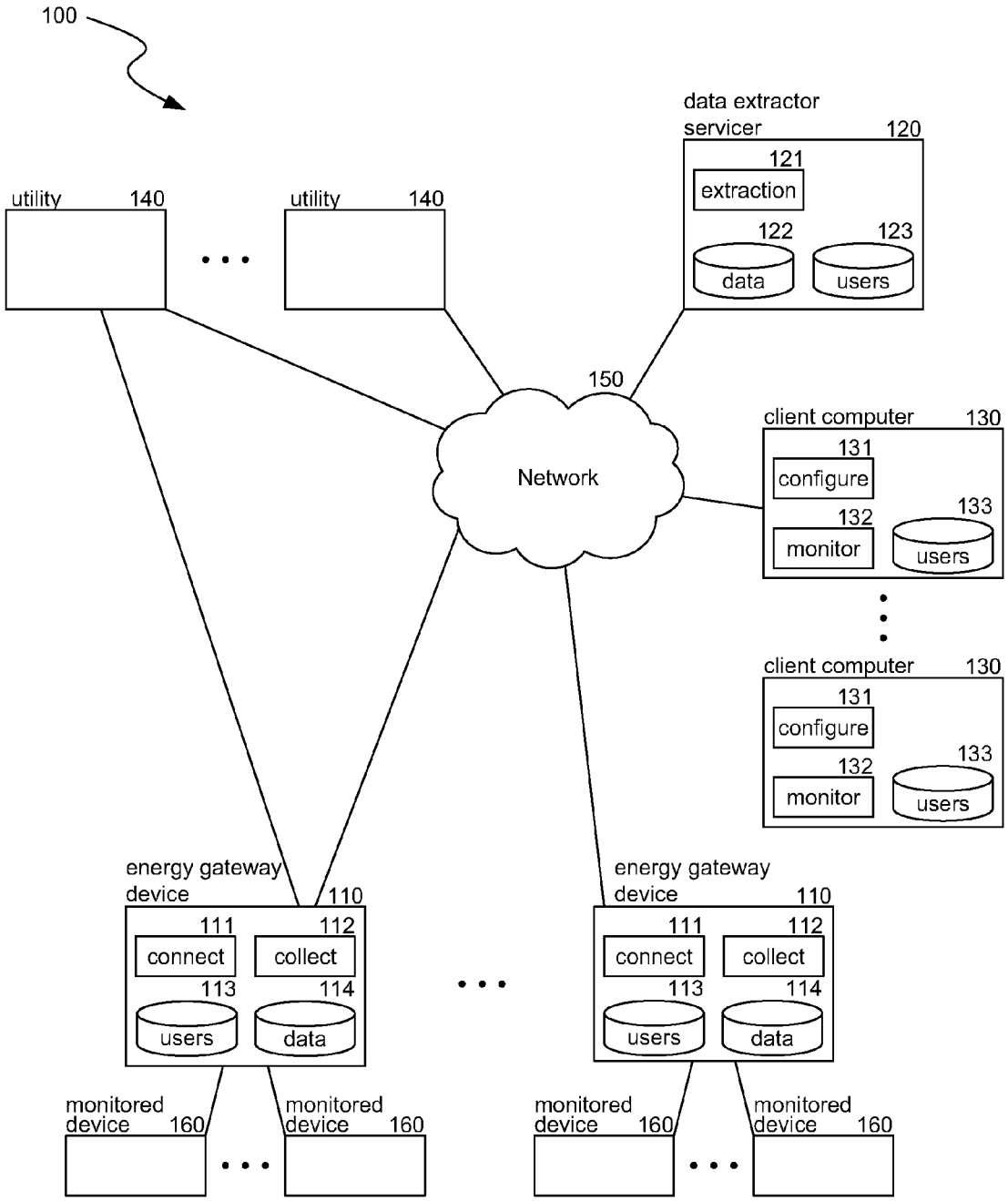
FIG. 1 is a block diagram illustrating an environment in which the facility may operate.

A facility comprising systems, methods, and techniques for collecting data indicative of energy consumption and/or energy production by energy systems and devices and providing the data to interested users and devices in real-time or near real-time is described. In some embodiments, the facility comprises an energy gateway device or bridge coupled to one or more monitored devices, one or more energy data extraction servers, and one or more client computers through which users may interact with the energy gateway device and/or the data extraction server. The energy gateway devices and energy data extraction servers are coupled to a network and are configured to 1) collect energy consumption and/or energy production data from one or more devices and 2) provide an indication of the collected data, in real-time or near real-time, to local and remote client computers and/or users for further analysis and/or display. In this manner, users can monitor energy consumption and production levels of various monitored devices in real-time or near real-time.

In some embodiments, a user of a client computer connects or logs into an energy gateway device by initially sending a request to an energy data extraction server. The data extraction server may be maintained by a utility company (e.g., electric company, gas company) or a third party. In some cases, the user can send a request to connect to the energy gateway device directly to the energy gateway device. The energy gateway device maintains a list or enumeration of monitored devices (i.e., devices accessible by the energy gateway device, such as energy meters, thermostats, battery chargers (e.g., car battery chargers), refrigerators, washers, dryers, water heaters, photovoltaic systems (e.g., roof-mounted photovoltaic systems), and so on). After the user is authenticated or otherwise determined to be authorized to access an energy gateway device, the energy gateway device transmits a list of monitored devices to a client computer associated with the user so that the user can select devices to monitor and the type of data that the user would like to monitor for the selected devices. For example, the client computer may display a user interface through which a user can select to monitor the consumption of energy measured by a monitored energy meter of a home, the energy consumed by a monitored water heater in the home, the energy produced by a monitored photovoltaic system within the home, and the price of energy predicted to be consumed within the home over the course of a predetermined period (e.g., the next 24 hours). In this manner, the user can select to monitor a customized set of the devices monitored by the energy gateway device (e.g., one or more). After the user has specified the devices and the data that the user is interested in, the client computer may forward the information to the data extraction server.

In some embodiments, the data extraction server stores an indication of the user's selections and forwards the indication of the selection to the energy gateway device. The energy gateway device collects data from the selected devices and sends the collected data to the data extraction server. For example, the energy gateway device may collect from selected monitored devices a current rate of energy consumption or production, a predicted energy consumption or production level over a future period of time, and/or the amount of energy that has been consumed or produced by the device over a previous period of time. In some examples, the energy gateway device may provide the data in units of energy (e.g., watt-hour, kilowatt-hour), units of power or rates of energy consumption or production (e.g., watt, kilowatt), units of currency (e.g., dollars), and/or value per unit of time of the energy consumed or produced (e.g., cents per second, dollars per month). The currency and value amounts may be based on a fee schedule periodically retrieved from a utility company. After receiving the data, the data extraction server can store the data and transmit the data to interested users via client computers.

In other embodiments, the energy gateway device is configured to automatically connect to the data extraction server and regularly push collected data to the data extraction server. For example, the energy gateway device may regularly poll connected devices for energy consumption and/or energy production data and provide the retrieved data to the data extraction server. In these embodiments, the data extraction server may send the user-desired data (i.e., energy consumption and/or production data collected for the user-selected devices) to the client computer without sending an indication of the user-selected devices to the energy gateway device. Rather, the data extraction server collects available information from the energy gateway device and acts as a repository and server of this information for interested parties. For example, the data extraction server may send an indication of a current rate of energy consumption or production, a predicted energy consumption or production level over a future period of time, and/or the amount of energy that has been consumed or produced by the device(s) over a previous period of time. The data extraction server may provide the data in units of energy, units of power, units of currency, and/or value per unit of time. The currency and value amounts may be based on a fee schedule periodically retrieved from a utility company.

In some embodiments, when the client computer receives the relevant data (from the data extraction server and/or the energy gateway device), the client computer displays an indication of the received data to a user. For example, the client computer may provide a graphical user interface that displays, for each monitored device, the available information that is of interest to the user as specified by the user, such as the amount of energy that the device is consuming (or producing), the amount of energy that the device previously consumed (or produced), the amount of energy that the device is expected to consume (or produce) during a future period, and/or the price (or value) of any consumed (or produced) energy. Moreover, the client computer may combine the data to provide a composite indication of energy consumption or production for a combination of one or more of the monitored devices, such as all monitored devices in one area of a home or building, the monitored devices responsible for consuming the most amount of energy (e.g., top five or top ten), the costliest monitored devices, and so on. One skilled in the art will recognize that any group of devices may be established by a user or the facility for purposes of energy consumption and/or production analysis.

FIG. 1 is a block diagram illustrating an environment 100 in which the facility may operate in some embodiments. The environment 100 includes energy gateway devices 110, data extraction server 120, client computers 130, utility 140, network 150, and monitored devices 160. Energy gateway devices 110 are comprised of connect component 111, collect component 112, users store 113, and data store 114. Each energy gateway device 110 resides at a location, such as an office building, residence, industrial complex, etc. and is coupled to one or more monitored devices 160, such as an electrical meter, smart appliance, and so on. Connect component 111 is invoked to establish a connection with data extraction server 120 and/or client computer 130 via network 150. Collect component 112 is invoked to collect data from monitored devices 160. Users store 113 stores user information, such as user credentials, user preferences (e.g., monitoring preferences), user permissions, and so on. Data store 114 stores data collected by collect component 112. Data extraction server 112 is comprised of extraction component 121, data store 122, and users store 123. Extraction component 121 is invoked to extract or receive information from energy gateway devices 110 and provide the data to client computers 130. Data store 122 stores data collected by extraction component 121. Users store 123 stores user information, such as user credentials, user preferences (e.g., monitoring preferences), user permissions, and so on. Client computers 130 are comprised of configure component 131, monitor component 132, and users store 133. Configure component 131 is invoked to configure an application executing on the client computer to provide energy consumption and/or energy production data relevant to monitored devices 160 that a user is interested in monitoring. Monitor component 132 is invoked by the configure component 131 to collect the relevant data and display an indication of the data via a graphical user interface. Users store 133 stores user information, such as user credentials, user preferences (e.g., monitoring preferences), user permissions, and so on. Utilities 140 represent utility providers, such as an electric company or a gas company. In this example, energy gateway devices 110, data extraction server 120, and client computers 130, and utilities 140 communicate via network 150 (e.g., the Internet) or may communicate directly via other physical or wireless connections.

The computing devices on which the disclosed facility is implemented and associated devices may include one or more central processing units or processors, memory, input devices (e.g., keyboard and pointing devices), output devices (e.g., display devices), and storage devices (e.g., disk drives). The memory and storage devices are computer-readable media that may be encoded with computer-executable instructions that implement the technology, which means a computer-readable medium that contains the instructions. In addition, the instructions, data structures, and message structures may be stored or transmitted via a data transmission medium, such as a signal on a communications link and may be encrypted. Various communications links may be used, such as the Internet, a local area network, a wide area network, a point-to-point dial-up connection, a cell phone network, a personal area network (e.g., a ZigBee-based network), and so on.

The disclosed facility and associated components may be described in the general context of computer-executable instructions, such as program modules, executed by one or more computers or other devices. Generally, program modules include routines, programs, objects, components, data structures, and so on that perform particular tasks or implement particular abstract data types. Typically, the functionality of the program modules may be combined or distributed as desired in various embodiments. In some embodiments, the facility may employ a REpresentational State Transfer architecture.

Embodiments of the technology described herein may take the form of computer-executable instructions, including routines executed by a programmable computer. Those skilled in the relevant art will appreciate that aspects of the technology can be practiced on computer systems other than those shown and described herein. Embodiments of the technology may be implemented in and used with various operating environments that include personal computers, server computers, handheld or laptop devices, multiprocessor systems, microprocessor-based systems, programmable consumer electronics, digital cameras, network PCs, minicomputers, mainframe computers, computing environments that include any of the above systems or devices, and so on. Moreover, the technology can be embodied in a special-purpose computer or data processor that is specifically programmed, configured or constructed to perform one or more of the computer-executable instructions described herein. Accordingly, the terms "computer" or "system" as generally used herein refer to any data processor and can include Internet appliances and hand-held devices (including palm-top computers, wearable computers, cellular or mobile phones, multi-processor systems, processor-based or programmable consumer electronics, network computers, mini computers and the like). Information handled by these computers can be presented at any suitable display medium, including a CRT display, LCD, LED display, OLED display, and so on.

The technology can also be practiced in distributed environments, where tasks or modules are performed by remote processing devices linked through a communications network. In a distributed computing environment, program modules or subroutines may be located in local and remote memory storage devices. Aspects of the technology described herein may be stored or distributed on computer-readable media, including magnetic or optically readable or removable computer disks, as well as distributed electronically over networks. Data structures and transmissions of data particular to aspects of the technology are also encompassed within the scope of the technology.

Figure 2:
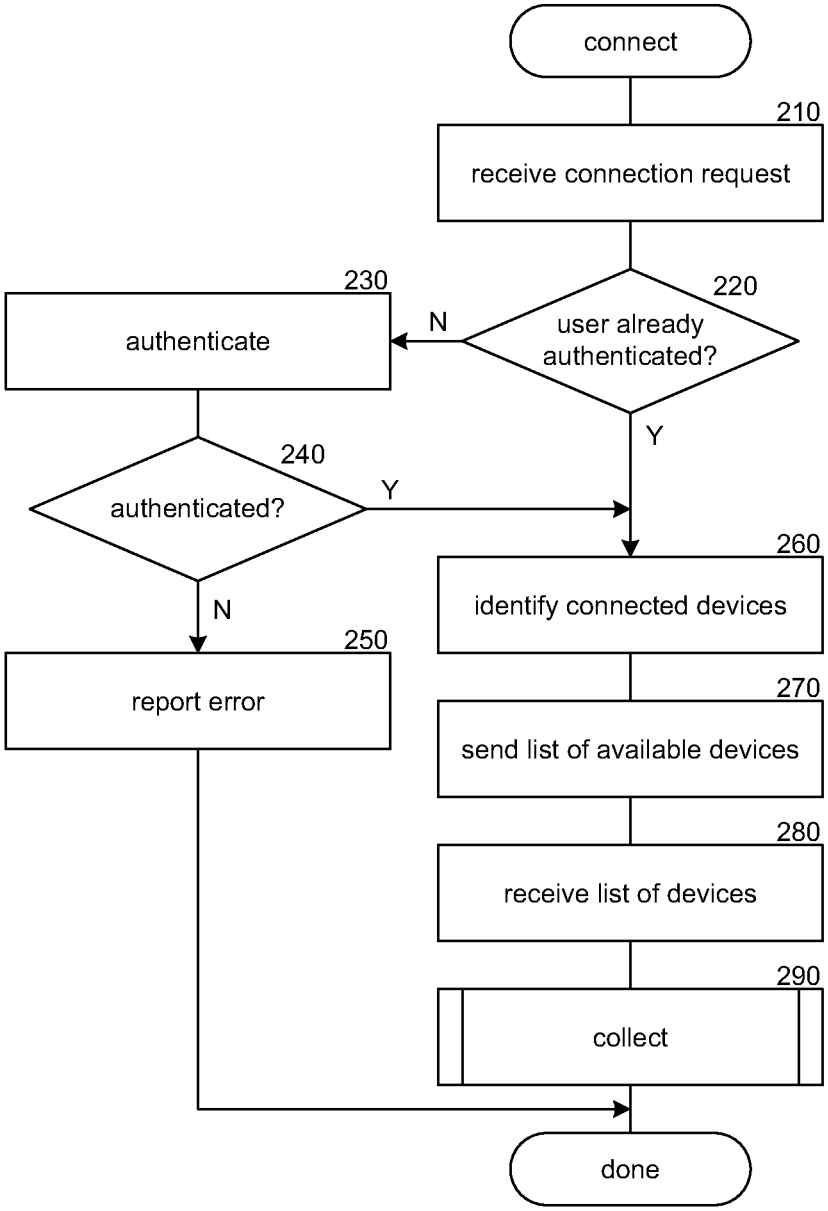
FIG. 2 is a block diagram illustrating the processing of a connect component.

FIG. 2 is a block diagram illustrating the processing of a connect component in some embodiments. The connect component is invoked by an energy gateway device to establish a connection with data extraction server and/or client computer. In block 210, the component receives a connection request. The connection request may come from a data extraction server or directly from a client computer used by a user. In decision block 220, if the requestor has already been authenticated (e.g., during a previous session, by the data extraction server, or via an application at the client computer) or otherwise determined to be authorized to establish a connection, then the component continues at block 260, else the component continues at block 230. In block 230, the component attempts to authenticate the requestor by, for example, providing a prompt through which a user can provide a username and password or other credentials or using credentials included in the connection request. In decision block 240, if the requestor is authenticated, then the component continues at block 260, else the component continues at block 250. In block 250, the component reports an error indicating that the requestor could not be authenticated and then completes. In block 260, the component identifies monitored devices that are connected to or accessible by the energy gateway device. In some embodiments, the monitored devices may be identified by an enumeration process while in other embodiments the energy gateway device may receive a list of monitored devices from an administrator when monitored devices are connected or disconnected. In block 270, the component sends a list of available monitored devices to the requestor directly and/or via the data extraction server. In block 280, the component receives a list of monitored devices that the requestor is interested in monitoring. In block 290, the component invokes a collect component to collect data from the monitored devices that the requestor is interested in monitoring.

Figure 3:
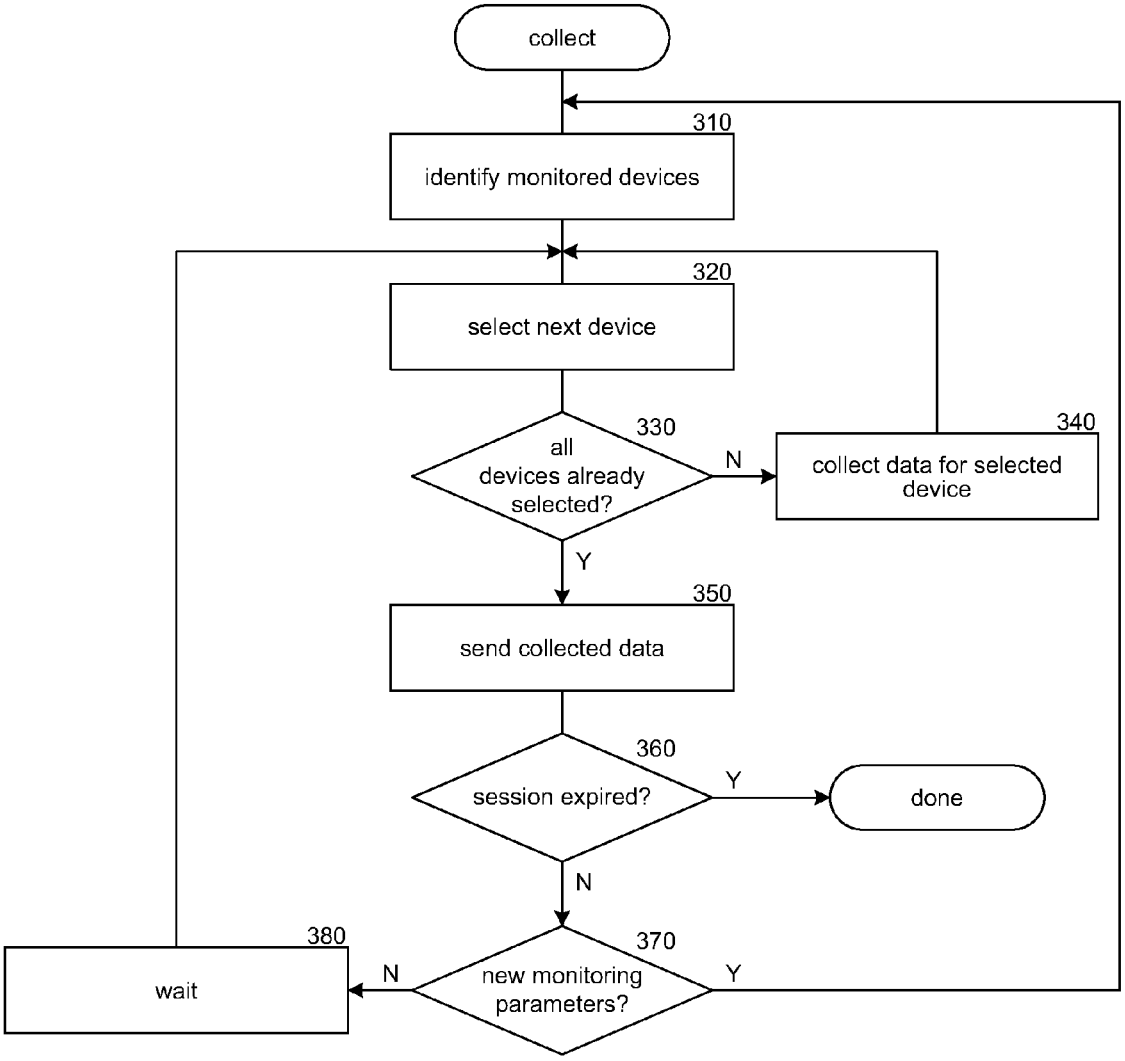
FIG. 3 is a block diagram illustrating the processing of a collect component.

FIG. 3 is a block diagram illustrating the processing of a collect component in some embodiments. The collect component is invoked by an energy gateway device to collect data from various monitored devices. In block 310, the component identifies the monitored devices that the party (e.g., a user) is interested in monitoring and the data that the party is interested in monitoring. In blocks 320-380, the component loops through each of the monitored devices and collects data from each of the monitored devices and sends the data to the party directly and/or via the data extraction server. In block 320, the component selects the next device from among the monitored devices that the party is interested in monitoring. In decision block 330, if all of the devices have already been selected, then the component continues at block 350, else the component continues at block 340. In block 340, the component collects data from the selected device and then loops back to block 320 to select the next device. For example, the component may poll the selected device to determine if any new data is available. In block 350, the component sends the collected data for each of the devices to the party directly and/or via the data extraction server. In decision block 360, if the session has expired, then the component completes, else the component continues at decision block 370. In decision block 370, if there are new monitoring parameters (e.g., if the party has modified the list of devices to monitor or the data that the party is interested in retrieving), then the component loops back to block 310 to identify the monitored devices, else the component continues at block 380. In block 380, the component waits a predetermined period of time (e.g., 100 ms, 30 seconds, 1 minute, 10 minutes) and then loops back to block 320 to collect new data from the monitored devices. In some embodiments, the wait period may adjust dynamically according to a schedule or in response to certain events. For example, the wait period may be increase during less active periods (e.g., at night) or in response to certain events, such as a scheduled event, a demand response request, and so on. In some embodiments, rather than checking each monitored device for new data, the monitored devices themselves may notify the component of new available data by, for example, sending the new data or a notification of the new data to the component.

Figure 4:
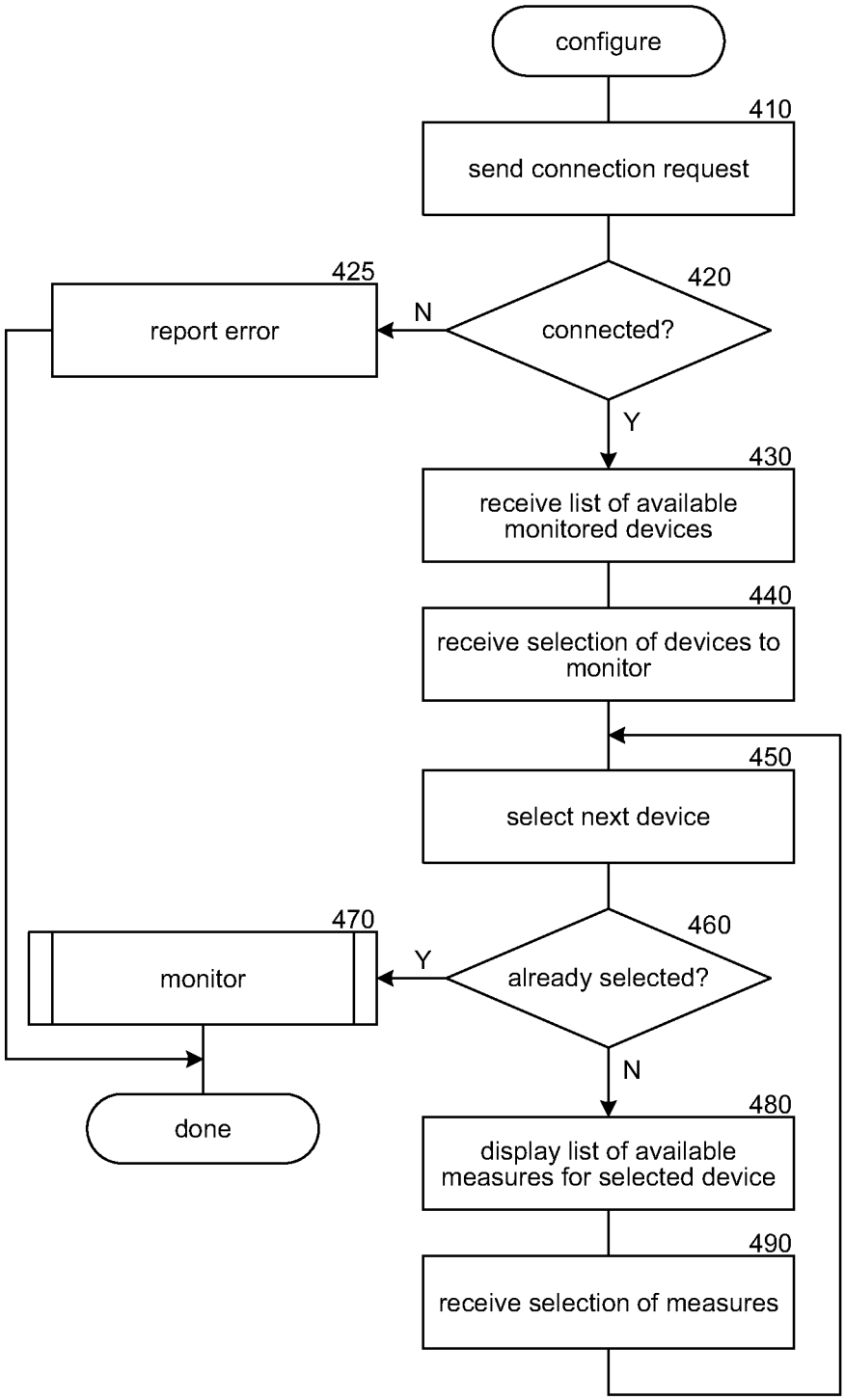
FIG. 4 is a block diagram illustrating the processing of a configure component.

FIG. 4 is a block diagram illustrating the processing of a configure component in some embodiments. The configure component is invoked at the client computer to configure an application to provide (e.g., display, print) energy consumption and/or energy production data relevant to monitored devices in which a user is interested. In block 410, the component sends a request to connect to an energy gateway device directly to the energy gateway device or via a data extraction server. In decision block 420, if the requested connection is established, then the component continues at block 430, else the component continues at block 425. In block 425, the component reports that the requested connection could not be established and then completes. In block 430, the component receives a list of monitored devices connected to or accessible by the energy gateway device. In block 440, the component receives, from the user, a selection of available monitored devices that the user is interested in monitoring. For example, the component may display a list of the available monitored devices and prompt the user to select those devices that the user is interested in monitoring. In blocks 450-490, the component loops through the devices that the user is interested in monitoring and allows the user to specify which measure the user is interested in for that device. In block 450, the component selects the next device. In decision block 460, if the selected device has already been selected then the component continues at block 470, else the component continues at block 480. In block 480, the component displays a list of available measures for the selected device, such as a current rate of energy consumption or production for the selected device, a predicted energy consumption or production level over a future period of time for the selected device, the amount of energy that has been consumed or produced by the selected device over a previous period of time, and so on. If energy pricing information is available the list of available measure may also include energy pricing measures, such as the cost of the energy (to be) consumed or the value of energy (to be) produced. In block 490, the component receives a selection of measures for the selected device and then loops back to block 450 to select the next device. In block 470, the component invokes a monitor component.

Figure 5:
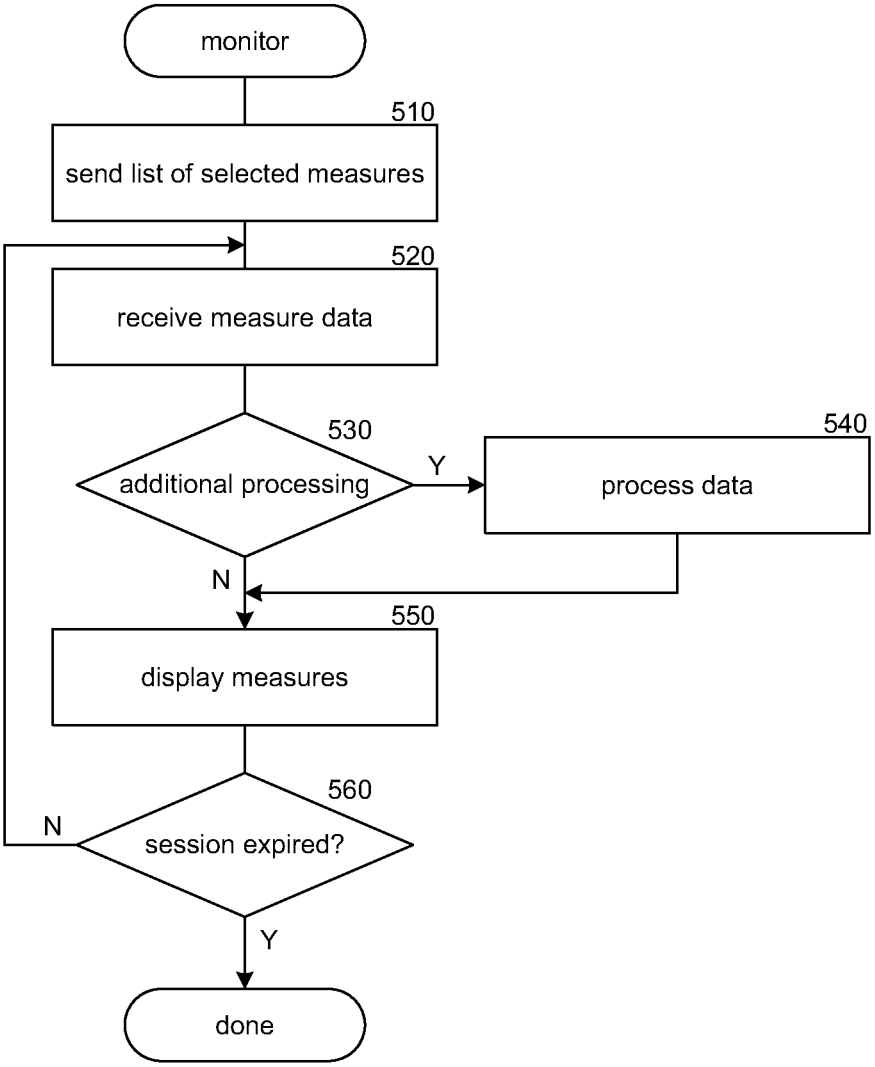
FIG. 5 is a block diagram illustrating the processing of a monitor component.

FIG. 5 is a block diagram illustrating the processing of a monitor component in some embodiments. The monitor component is invoked by a configure component to collect the relevant measure data and display an indication of the data via a graphical user interface. In block 510, the component sends a list of selected measures to a data extraction server or to an energy gateway device. In block 520, the component receives measure data. In decision block 530, if the received measure data is to be further processed, then processing continues at block 540, else processing continues at block 550. In block 540, the component performs additional processing of the received data. For example, the component may compute price and value information based on retrieved pricing information, generate composite measures based on individual measures received for different monitored devices, and so on. In block 550, the component displays the measure data to the user. One skilled in the art will recognize that the component may display the measure data to a user in any number of ways, such as different graphical user interface screens or display pages for different monitored devices, a single screen or display page for multiple monitored devices, a scrollable screen or display page for one or more monitored devices, and so on. In decision block 560, if the session has expired then the component completes, else the component loops back to block 520 to receive additional measure data.

Figure 6:
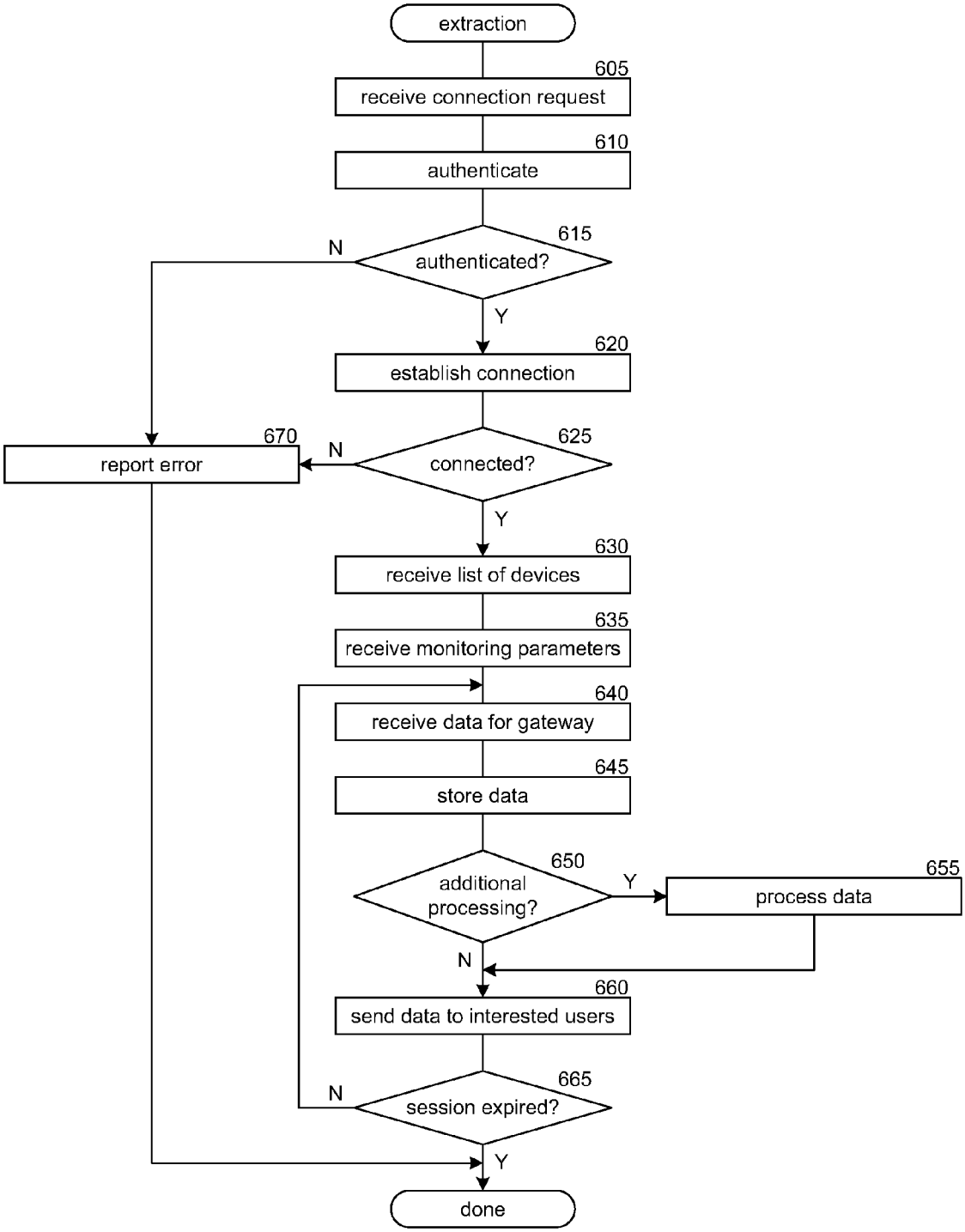
FIG. 6 is a block diagram illustrating the processing of an extraction component.

FIG. 6 is a block diagram illustrating the processing of an extraction component in some embodiments. The extraction component is invoked by a data extraction server to extract or receive information from energy gateway devices and provide the data to client computers. In block 605, the component receives a connection request. In some examples, the connection request may come from a client computer while in other examples the connection request is generated at the data extraction server. In block 610, the component attempts to authenticate the source of the request based on credentials included with the request or otherwise determine that the source of the request is authorized to extract information from an energy gateway device. In decision block 615, if the source is authenticated then the component continues at block 620, else the component continues at block 670. In block 670, the component reports an error and then completes. In block 620, the component attempts to establish a connection with an energy gateway device. In decision block 625, if the connection is established, then processing continues at block 630, else the component continues at block 670. In block 630, the component receives a list of monitored devices from the energy gateway device. In block 635, the component receives a list of monitoring parameters, such as which devices to monitor, how often to refresh the data collected from those devices, which measures to collect or store for those devices, and so on. The monitoring parameters may be generated or selected by a user of a client computer or may be generated or selected by the data extraction server or an administrator of the server. In block 640, the component receives, from the energy gateway device, consumption and/or production data for monitored devices indicative of various measures for those devices, such as a current energy consumption or production rate for the selected device, a predicted energy consumption or production level over a future period of time for the selected device, the amount of energy that has been consumed or produced by the selected device over a previous period of time, pricing and value information, and so on. In block 645, the component stores the received consumption and/or production data. In decision block 650, if the received consumption and/or production data is to be further processed, then processing continues at block 655, else processing continues at block 660. In block 655, the component performs additional processing of the received consumption and/or production data. For example, the component may compute price and value information based on retrieved pricing information, generate composite measures based on individual measures received for different monitored devices, and so on. In block 660, the component sends received data to client computers associated users who have selected to monitor devices for which the component has collected consumption and/or production data. In decision block 665, if the session has expired, the component completes, else the component loops back to block 640 to collect additional data from the energy gateway device.

Although the subject matter has been described in language specific to structural features and/or methodological acts, it is to be understood that the subject matter defined in the appended claims is not necessarily limited to the specific features or acts described above. For example, the order of the steps may be rearranged; some steps may be performed in parallel; shown steps may be omitted, or other steps may be included; etc. Rather, the specific features and acts described above are disclosed as example forms of implementing the claims. Accordingly, the invention is not limited except as by the appended claims.

I claim:

1. A method, performed by a server computer, having a processor, for collecting and providing real-time updates of energy consumption to a user, the method comprising:

receiving, from a client computer, a request to connect to an energy gateway device, the request comprising user credentials;

determining, based on the user credentials, whether the client computer is authorized to connect to the energy gateway device;

forwarding, by the server computer, to the energy gateway device, the request to connect to the energy gateway device;

receiving, from the energy gateway device, an enumeration of monitored energy devices for which the energy gateway device is configured to collect energy data;

receiving, from the client computer, a selection of monitored energy devices;

receiving, from the energy gateway device, an indication of energy data for each of the selected monitored energy devices;

for each of the selected monitored energy devices, generating, with the processor, at least one measure based on the received energy data wherein at least one measure is generated at least in part by, retrieving an energy pricing schedule from a utility, and determining a value of energy produced or consumed by the at least one monitored device based at least in part on the retrieved energy pricing schedule; and sending, to the client computer, an indication of the generated at least one measure.

2. The method of claim 1, further comprising:

generating a composite measure based on at least two measures generated for different monitored energy devices.

3. The method of claim 1 wherein the selected monitored energy devices include at least one energy-consuming device.

4. The method of claim 1 wherein the selected monitored energy devices include at least one energy-producing device.

5. The method of claim 1 wherein the indication of energy data for at least one of the selected monitored energy devices includes a measure in units of power.

6. The method of claim 1 wherein the indication of energy data for at least one of the selected monitored energy devices includes a measure in units of energy.

7. An energy gateway computing system for collecting energy consumption data from one or more devices and providing the data for distribution, the system comprising:

a component configured to establish a connection with a remote data extraction server;

a component configured to periodically retrieve energy data from each of a plurality of monitored devices;

a component configured to receive, from the remote data extraction server, a list of a plurality of available monitored devices;

a component configured to periodically transmit, for each of the plurality of available monitored devices, an indication of retrieved energy data for that monitored device, wherein the indication of retrieved energy data for at least one monitored device represents a value of energy produced by the at least one monitored device;

a component configured to retrieve an energy pricing schedule from a utility; and a component configured to determine the value of energy produced by the at least one monitored device based at least in part on the retrieved energy pricing schedule.

8. The energy gateway computing system of claim 7 wherein the component configured to periodically retrieve energy data from each of a plurality of monitored devices is configured to retrieve energy data from at least one energy-consuming device.

9. The energy gateway computing system of claim 7 wherein the component configured to periodically retrieve energy data from each of a plurality of monitored devices is configured to retrieve energy data from at least one energy-producing device.

10. The energy gateway computing system of claim 7 wherein the indication of retrieved energy data for at least one monitored device represents a cost of energy consumed by the at least one monitored device.

11. The energy gateway computing system of claim 7, further comprising:

a component configured to compute price information based on the retrieved energy pricing schedule.

12. A computer-readable medium, that is not a transitory, propagating signal, storing instructions that, if executed by a computing system having a processor, cause the computing system to perform operations comprising:

receiving, from a user, a request to connect to an energy gateway device remote from the computing system;

in response to receiving the request, forwarding the request to a data extraction server;

receiving, from the data extraction server, a list of monitored devices accessible by the energy gateway device;

displaying the list of monitored devices accessible by the energy gateway device;

receiving, from the user, a selection of monitored devices;

for each of a plurality of the selected monitored devices, displaying an indication of energy measures available for retrieval from the data extraction server, and displaying an indication of energy measures that can be generated based on data retrievable from the data extraction server;

receiving, from the user, a selection of energy measures; and for each of the selected energy measures, displaying an indication of the selected energy measure.

13. The computer-readable medium, that is not a transitory, propagating signal, of claim 12, the operations further comprising:

for each of a first plurality of selected energy measures, receiving energy data indicative of energy consumption by one of the selected devices.

14. The computer-readable medium, that is not a transitory, propagating signal, of claim 12, the operations further comprising:

for each of a first plurality of selected energy measures, receiving energy data indicative of energy production by one of the selected devices.

15. The computer-readable medium, that is not a transitory, propagating signal, of claim 12 wherein the list of monitored devices accessible by the energy gateway device includes at least one energy-consuming device and at least one energy-producing device.

16. The computer-readable medium, that is not a transitory, propagating signal, of claim 12 wherein the energy gateway device is remotely located from the computing system.

17. The computer-readable medium, that is not a transitory, propagating signal, of claim 12, the operations further comprising:

for each of a plurality of the selected monitored devices, for each of a plurality of energy measures associated with the selected monitored device, determining whether the energy measure is available for retrieval from the data extraction server, and for each energy measure that is not available for retrieval from the data extraction server, determining whether the energy measure can be generated based on data retrievable from the data extraction server.

18. The computer-readable medium, that is not a transitory, propagating signal, of claim 17, the operations further comprising:

for each selected energy measure available for retrieval from the data extraction server, sending, to the data extraction server, a request for the selected energy measure, and retrieving, from the data extraction server, the requested selected energy measure.

19. The computer-readable medium, that is not a transitory, propagating signal, of claim 17, the operations further comprising:

for each energy measure that is not available for retrieval from the data extraction server and that can be generated based on data retrievable from the data extraction server, sending, to the data extraction server, a request for data related to the selected energy measure, retrieving, from the data extraction server, the requested data related to the selected energy measure, and generating the selected energy measure based at least in part on the retrieved data related to the selected energy measure.

20. The computer-readable medium, that is not a transitory, propagating signal, of claim 12, the operations further comprising:

retrieving an energy pricing schedule; and computing price information based on the retrieved energy pricing schedule.

* * * * *